US005078451A

United States Patent [19]

Sobel

[11] Patent Number: 5,078,451

[45] Date of Patent: Jan. 7, 1992

[54] PORTABLE ROTATABLE BEACH CHAISE LOUNGE

[76] Inventor: David J. Sobel, 222 East Main St., Smithtown, N.Y. 11787

[21] Appl. No.: 568,184

[22] Filed: Aug. 16, 1990

[51] Int. Cl.[5] ..... A47C 7/62

[52] U.S. Cl. ..... 297/349; 248/425

[58] Field of Search ..... 297/349; 108/94; 248/425, 349

[56] References Cited

U.S. PATENT DOCUMENTS

| | | | |
|---|---|---|---|
| 106,460 | 8/1870 | Boyd | 108/94 |
| 1,428,275 | 9/1922 | Dahl | 108/94 |
| 2,788,843 | 4/1957 | Gerson | 248/425 X |
| 2,812,012 | 11/1957 | Hansburg | 297/349 X |
| 2,876,825 | 3/1959 | Boortz | 248/425 X |
| 2,916,084 | 12/1959 | Bottemiller et al. | 297/349 X |
| 3,199,826 | 8/1965 | Miller et al. | 248/349 X |
| 4,482,184 | 11/1984 | Mincey | 297/349 |
| 4,544,202 | 10/1985 | Keaton | 297/349 |
| 4,824,170 | 4/1989 | Goldmeier | 297/349 |

*Primary Examiner*—Peter A. Aschenbrenner
*Attorney, Agent, or Firm*—Alfred Walker

[57] ABSTRACT

A portable beach chaise lounge rotatable assembly is provided. The chair portion of the chaise lounge rotates about a circular track means enabling the upper portion to rotate above a stationary support portion. The upper portion rotates 360 degrees and swivels above a corresponding lower ballbearing laden circular track for smooth movement of the upper circular portion and the corresponding chaise lounge. For easy carrying, the lower support portion is attached to hinged collapsible leg portions which collapse inward towards each other in a parallel fashion in two pairs. The upper rotatable portion is supported by hinged support stanchions which collapse in a complimentary fashion such that the two pairs of support stanchions collapse in a direction parallel to each other.

7 Claims, 2 Drawing Sheets

Fig. 3
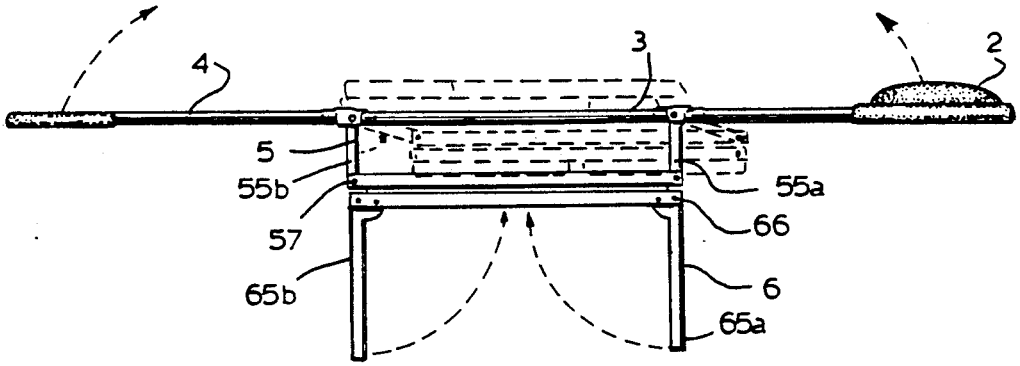
Fig. 4
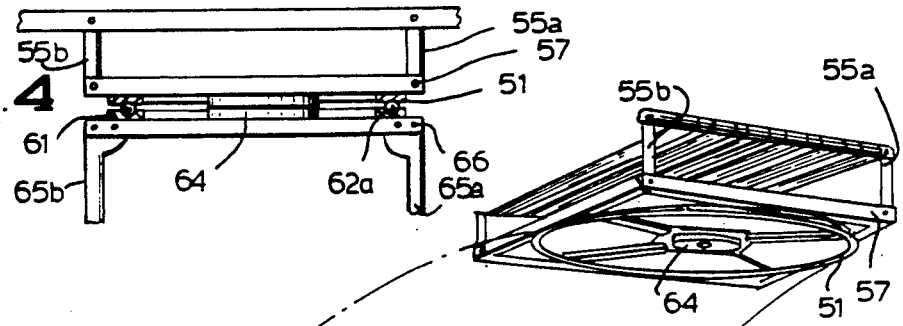
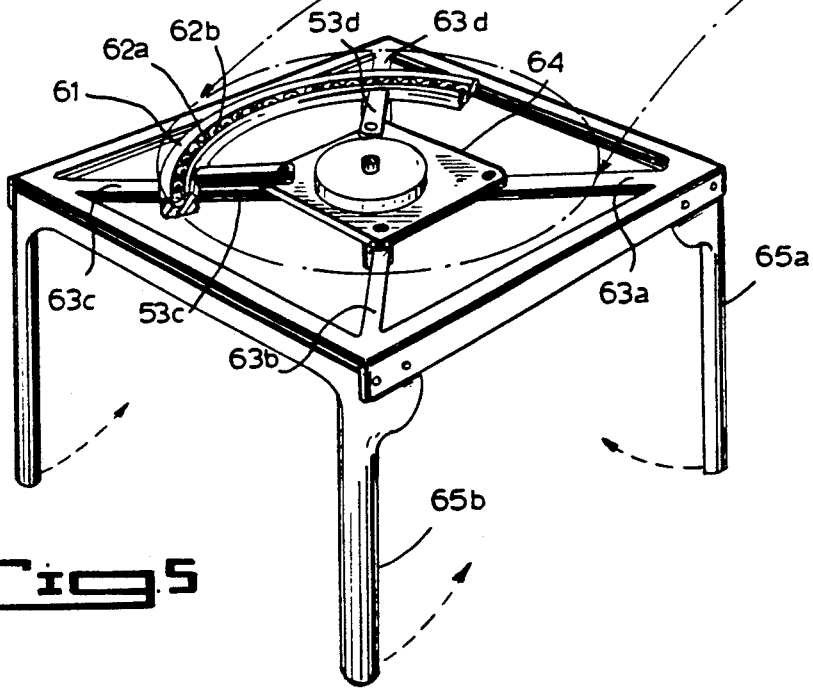
Fig. 5

PORTABLE ROTATABLE BEACH CHAISE LOUNGE

BACKGROUND OF THE INVENTION

This invention relates to a portable, rotatable beach chaise lounge chair, more specifically, to a rotatable upper portion which rotates the chair above a stationary portion having a circular track means corresponding to a circular track means within the upper portion.

The prior art does not permit the movement of chaise lounges on such a tracking system which is also collapsible for easy carrying. In this invention, the user can rotate 360 degrees to change direction with the changing location of the sun over a period of time during a day. Furthermore, for safety reasons, a parent or guardian can move the chair to watch small children without having to move ones self from the chaise lounge and reposition the entire chair itself at a different angle of reference.

Rotatable chairs are generally known in the art at U.S. Pat. Nos. 3,891,267; 4,687,248; 4,773,708; 4,802,708; 4,863,281; 3,424,423.

U.S. Pat. Nos. 3,891,267; 4,802,708 and 3,424,423 are cited with respect to a swivel structure and U.S. Pat. No. 3,863,281 a swivel and folding means but applied to a bed. U.S. Pat. No. 3,891,267 also shows the application to a swivel of a folding chair but not of a beach type chair.

Furthermore, in an unpatented device, as found in the Hammacher-Schlemmer catalog at page 9 shows a sun tracking beach chair which moves in a circular fashion with a different structure which is not collapsible as the instant invention is.

The present invention improves upon the prior art by providing not only a rotatable chair but a rotatable, collapsible chair which is easily maneuverable. The instant invention also provides stability by distributing the weight outwardly along a circular track to provide stability when a person sits upon the chair.

It is an object of the invention to provide a rotatable, swivelable beach chair. It is a further object to provide a collapsible rotatable beach chair. It is a further object to provide a stable, rotatable, collapsible beach chair. It is a further object to provide an easily transportable, collapsible and rotatable beach chair. It is further object to provide a chair which has structural strength.

SUMMARY OF THE INVENTION

The invention consists of a rotatable, collapsible and portable beach chaise lounge chair. The invention provides an upper support mechanism to support the chaise lounge chair portion which, support section is also rotatable about a circular track laden with ballbearings contained in a stable nonmovable base portion. Each of the two upper and lower support portions consists of support frames supporting the circular tracks which support frames themselves are supported by folding support means for easy collapsibility of the chair. The lower support portion has legs which fold inward and are hingeably attached to the lower support frames. The upper rotatable support assembly mechanism is braced by hinged support stanchions comprising two pairs of stanchions which collapse in a direction which is in a parallel fashion complimentary to each other pair of upper support stanchions. The upper support portion holds an upper circular track means, generally upside down U-shaped, within which the upper portions of the ballbearings, laden within the lower circular track means, are disposed. The upper circular portion is bracketed to a conventional chair turntable means for rotation of the upper circular support means above the ballbearing laden lower circular track means. The upper circular portion is attached to the upper support mechanism to allow the rotatable swiveling of the chair in any direction upon a beach while the lower support portion is anchored within the sand of the beach.

BRIEF DESCRIPTION OF THE DRAWINGS

FIG. 3 is a side view of the device showing in dotted lines the collapsibility of the device.

FIG. 4 is a side view of the upper and lower support assembly portions of the device.

FIG. 5 is a perspective view of the rotatable assembly portions of the device showing in an exploded view the upper portion from underneath.

Figure 1:
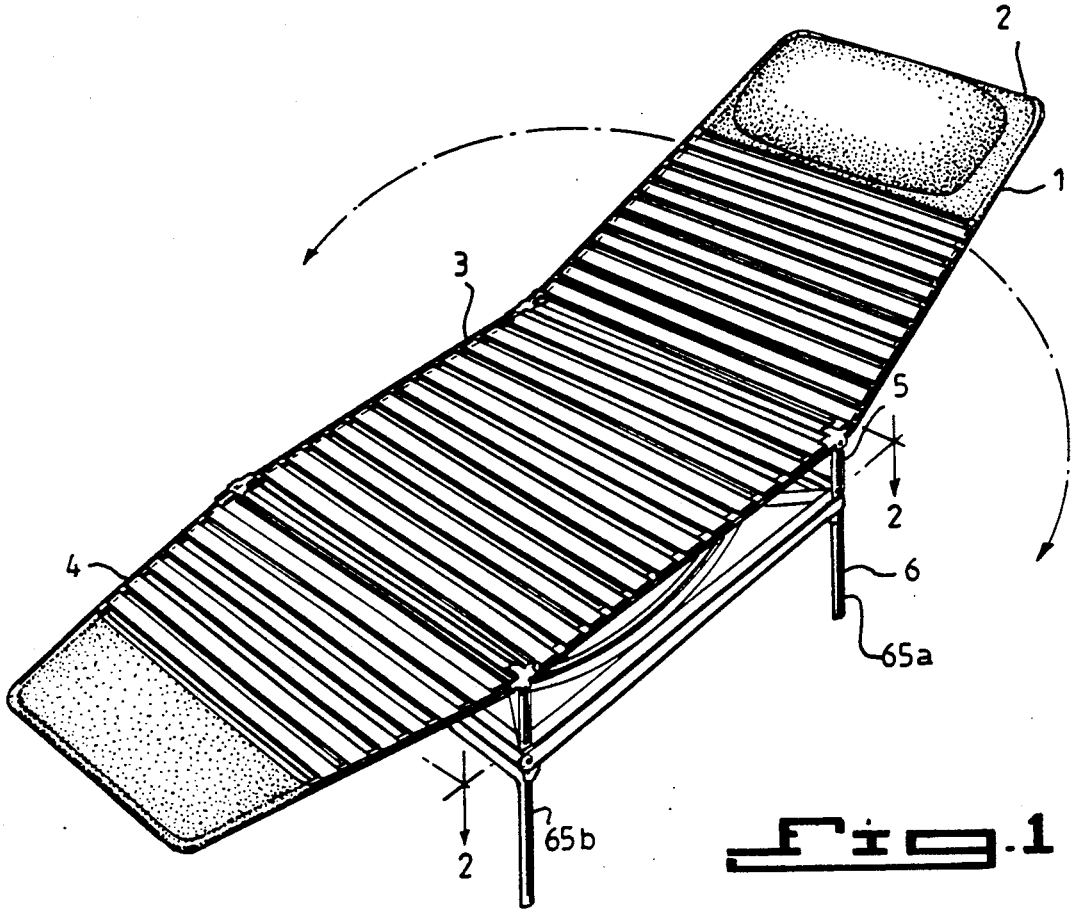
FIG. 1 is a perspective view of the device.

Illustrated at FIG. 1 showing a reclining chaise lounge (1) having a head portion (2), a seat portion (3) and a foot portion (4) which rests on top of an upper rotatable assembly mechanism (5) which itself rests upon lower support section (6).

Figure 2:
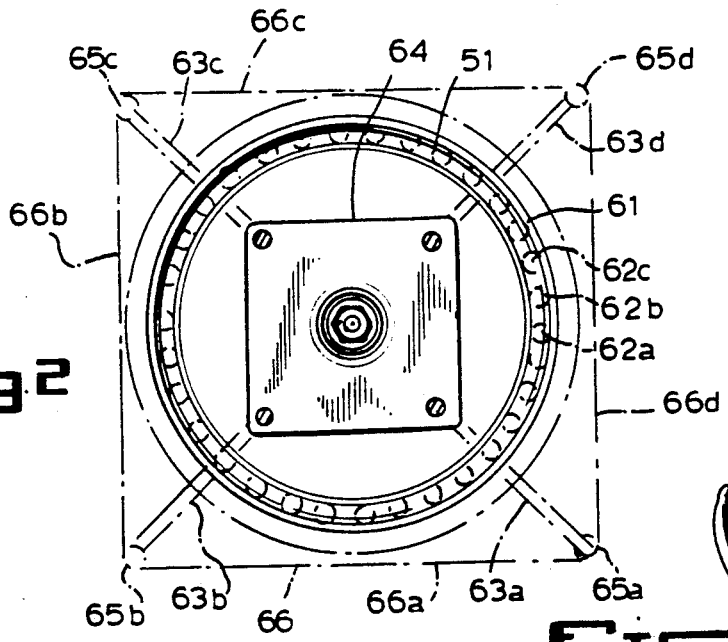
FIG. 2 is a top view of the swivel mechanism of the device.

As shown in FIG. 2 it is shown from the top view a chair rotating mechanism wherein a circular track means (51) of the upper rotatable assembly mechanisms (5) is rotatable over a circular track means (61) of the lower support assembly means (6) which circular track means is laden with a plurality of ballbearing (62*a, b, c*), etc. about which upper circular track means (51) rotates. lower support assembly means (6) also contains lower diagonal cross beam extensions (63*a, b, c*, and *d*) which lower extension beams connect conventional turntable means (64) with lower track means (61) within lower assembly (6). Lower support legs (65*a, b, c* and *d*) are connected to corresponding lower diagonal cross beams extensions (63*a, b, c* and *d*). The lower diagonal cross beam extensions (63*a, b, c* and *d*) are correspondingly connected to side frames (66*a, b, c* and *d*), which form a square construction frame for structural strength and stability.

As shown in FIG. 3, the mechanism is a fully collapsible beach chair (1) such that the head, seat and foot sections (2, 3 and 4) of the chair portion (1) are connected to the upper support stanchions (55*a, b, c* and l *d*) which support stanchions are hinged and movably collapsible with respect to each other in a complimentary fashion such that the pairs (55*a* and *d*) collapse in a parallel direction with the collapsible direction of pairs (55*b* and *c*). On the contrary folding lower support means (65*a, b, c* and *d*) collapse in pairs in a radial fashion towards each other.

As shown herein in FIG. 4 the upper support section (5) comprises support stanchions (55*a, b, c* and *d*) which are connected to an upper support frame (57), which has itself generally upside down U-shaped circular track means (51) such that the top of ballbearings (62*a, b, c*, etc.) rotate at the upper curved portion within inverse U-shaped track means (51) to cause movement of the upper support mechanism (5) about stationary circular track means (61). The lower stationary track means (61) has generally U-shaped grooves within which the ballbearings (62*a, b, c*, etc.) rotate in all directions to permit the swivelable rotation of upper circular track means and thereby the beach chair above said upper circular track means (51). The circular track means (51 and 61) are connected to conventional turntable means (64) by means of upper and lower diagonal cross beam sections (53*a, b, c* and *d*; and 63*a, b, c* and *d*). The lower circular portion is connected to lower support frame (66) comprising of four cross beam sections (66*a, b, c* and *d*) which form a square about which lower support legs (65*a, b, c* and *d*) extend downward into the sand for structural stability.

The upper and lower cross beams sections provide structural stability to the square-shaped lower support frame. The lower support beam extensions extend from corner to corner. However, the upper support diagonal cross beams extend from the conventional turntable means (64) to the inner edge of the upper rotatable circular track means (51) as shown in FIG. 5.

The diameter of the circular track means (51 and 61) is almost the width of the seat portion (3) of the chaise lounge chair (1), to distribute the weight of the user outwardly so as to cause stability for a user sitting at the edges of the chair. This stability is further enhanced by the placement of a diagonal lower cross beams (63*a, b, c* and *d*) which extend in an X configuration from corner to corner underneath the turntable means to the four corners of the lower support frame (66) comprising four beam sections (66*a, b, c* and *d*).

The mounting arrangement of the two circular frames permits the easy and glidable motion of the swivel chair about a fixed structural support frame for easy movement of the chaise lounge in any direction upon the sand without repositioning of the chair every time a directional change is desired by the user. The ballbearings permit an even distribution of the weight during rotation so that the friction is minimalized while the chair is initially moved from a stationary position.

In use, a person first extends from the folded, collapsible position the lower support legs (65*a, b, c* and *d*) downward into the sand to permit a snug fit of the chair within the sand. With a second manual movement the upper portion unfolds from its resting parallelogram configuration and adjustably snaps into place such that the chair is now elevated above the sand at a desirable height where it can be rotated in any direction as the user desires.

Not in use, the chair is easily collapsible by first collapsing the chaise lounge head and foot portions inwardly and then collapsing the upper support legs of the upper support mechanism which collapse in a parallelogram fashion and then finally grasping and inwardly collapsing towards each other the four lower support legs (65*a, b, c* and *d*). This allows the chair to be carried manually without excess bulk and can be easily stored with a plurality of other chairs within the confines of a automobile trunk.

Figure 2A:
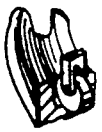
FIG. 2A is a closeup view of an alternative swivel mechanism of the device.

Other embodiments may be encompassed in the invention. For example, as shown in FIG. 2A, instead of a plurality of ball bearings, four equally spaced casters with roller wheels may be attached to the underside of a circular track means and movable within a corresponding lower circular track means to facilitate the swivelling of the chair.

Itk should be clear that other embodiments of the invention may be constructed, without departing from the scope of the invention, as defined in the following claims.

I claim:

1. A collapsible, rotatable, portable chaise lounge beach chair comprising:

a chaise lounge chair portion with head, seat and foot portions mounted atop a collapsible upper support frame means, said upper suppprt means rotatable about a lower track means, said lower support means having support stanchions;

a pair of reciprocal circular track means, said upper support means further including an assembly having an upper frame, said upper frame attachable at its upper end to said chaise lounge chair portion, said upper frame having a plurality of movable hinged support sections, said upper frame further having at its lower end an upper circular track means of said pair of reciprocal circular track means movably attachable to a lower circular track means within a lower frame, said upper circular track means having an inverse U shaped profile configuration in cross section, a means for rotating of a plurality of rotatable members, said rotatable members further being rotatable in any direction within said lower circular track means of said pair of reciprocal circular track means, said lower means having a reciprocal generally U shaped profile configuration in cross section, said lower support means further including a lower frame attachable to said lower circular track means, said lower frame further having a plurality of support legs, a turntable having upper and lower portions connected to said upper and lower track means by means of a plurality of diagonal extending cross beams, extending from each of the corners of each of said upper and lower portions of said turntable, a means for distributing the weight of a user of said beach chair, said means for distributing the weight of a user of said beach chair, including said pair of reciprocal circular track means each having a diameter having a width equal to almost the width of said seat portion.

2. The beach chair as recited in claim 1, wherein said rotatable members are ball bearings.

3. The beach chair as recited in claim 2, wherein said rotatable members are rotatable casters with rotatable roller wheels.

4. The invention as in claim 1 wherein the upper support means are collapsible in pairs such that each pair collapses in a direction parallel to the other of said pairs.

5. The invention as in claim 1 wherein the lower support legs are collapsible inward in pairs such that each pair of legs collapses in a direction towards each other of said pairs.

6. The invention as in claim 1 wherein the lower support means further comprises a turntable, a means connecting said turntable to said lower circular track means and said frame such that the upper circular track means rotates about the lower track means.

7. The invention as in claim 1 wherein the lower support means further comprises a turntable, a means connecting said turntable to said lower circular track means and said frame such that the upper circular track means rotates about the lower track means.

* * * * *